US006175784B1

(12) United States Patent
Jicha et al.

(10) Patent No.: US 6,175,784 B1
(45) Date of Patent: Jan. 16, 2001

(54) REMOTELY OPERATED RAIL CAR STATUS MONITOR AND CONTROL SYSTEM

(75) Inventors: Thomas Richard Jicha, Elk River; Randy Wallace Lokken, Minnetonka, both of MN (US)

(73) Assignee: Honeywell, Inc., Morristown, NJ (US)

( * ) Notice: Under 35 U.S.C. 154(b), the term of this patent shall be extended for 0 days.

(21) Appl. No.: 09/370,744

(22) Filed: Aug. 9, 1999

(51) Int. Cl.[7] ..... G06F 17/00; G06F 7/00

(52) U.S. Cl. ..... 701/19; 701/2; 701/20; 188/107; 246/122 R; 246/182 R

(58) Field of Search ..... 701/2, 19, 20, 701/70, 83; 246/91, 122 R, 182 R; 303/122.03, 122.05; 188/107, 112 R

(56) References Cited

U.S. PATENT DOCUMENTS

| | | | | |
|---|---|---|---|---|
| 4,614,945 | | 9/1986 | Brunius et al. | 340/870.03 |
| 4,654,662 | | 3/1987 | Van Orsdel | 340/870.03 |
| 4,683,472 | | 7/1987 | Beling | 340/870.02 |
| 4,688,038 | | 8/1987 | Giammarese | 340/870.02 |
| 4,792,946 | | 12/1988 | Mayo | 370/86 |
| 4,874,065 | * | 10/1989 | Engle | 188/265 |
| 5,469,941 | * | 11/1995 | Horvath | 188/107 |
| 5,526,357 | * | 6/1996 | Jandrell | 370/346 |
| 5,533,695 | * | 7/1996 | Heggestad et al. | 246/62 |
| 5,684,472 | | 11/1997 | Bane | 340/870.02 |
| 5,726,646 | | 3/1998 | Bane et al. | 340/870.03 |
| 5,767,790 | | 6/1998 | Jovellana | 340/870.02 |

* cited by examiner

*Primary Examiner*—William A. Cuchlinski, Jr.
*Assistant Examiner*—Gertrude Arthur
(74) *Attorney, Agent, or Firm*—Kris T. Fredrick

(57) ABSTRACT

A remotely operated rail car status monitor and control system including a plurality of handbrake status and release monitors (HSRMs), each of which is mounted to an individual rail car of a train, and a handheld data terminal (HDT). The HSRMs are self-contained electronic sensing and control devices capable of short range radio frequency (RF) communication with the HDT, and are mounted to rail car handbrakes configured for remote release. Each HSRM is programmed with a unique ID code which corresponds to the rail car's identifier. The HSRMs monitor and record the operational state of systems on the rail car such as the handbrake, load weight and refrigerator car temperature. Operating characteristics of the train such slid wheel events and handling impacts can be monitored and stored. Systems of the rail car such as the handbrake can also be released or otherwise controlled. The HDT is a self-contained portable electronic device by which an operator can effectively and conveniently communicate with individual HSRMs by using their unique ID codes. Using the HDT an operator can retrieve information on the current operational state of the rail car handbrake and other systems, and information on the train operating characteristics. The handbrake and other systems can also be remotely released or otherwise actuated through use of the HDT. Information retrieved by the HDT can be stored and displayed on the device or downloaded to a computer.

33 Claims, 8 Drawing Sheets

| MSG BYTE | DATA BYTE | DESCRIPTION |
|---|---|---|
| 0 | | START SYMBOL |
| 1 | | TO/FROM |
| 2 | | PACKET NUMBER |
| 3 | | NUMBER OF DATA BYTES |
| 4 | 1 | DATA BYTE - CAR ID, ALPHA MSB |
| 5 | 2 | CAR ID, ALPHA |
| 6 | 3 | CAR ID, ALPHA |
| 7 | 4 | CAR ID, ALPHA LSB |
| 8 | 5 | CAR ID, NUMERIC MSB |
| 9 | 6 | CAR ID, NUMERIC |
| 10 | 7 | CAR ID, NUMERIC |
| 11 | 8 | CAR ID, NUMERIC |
| 12 | 9 | CAR ID, NUMERIC |
| 13 | 10 | CAR ID, NUMERIC |
| 14 | 11 | BRAKE LOCATION, _, A OR B |
| 15 | 12 | SENSOR STATUS - 1 = SET, 0 = REL. |
| 16 | 13 | HSRM STATUS - 1 = FAIL, 0 = OK. |
| 17 | 14 | SOFTWARE ID |
| 18 | 15 | WAKE UP, RELEASE COUNT, MOST SIGNIFICANT NIBBLES. |
| 19 | 16 | WAKE UP, COUNT, LEAST SIG BYTE. |
| 20 | 17 | RELEASE COUNT, LEAST SIG BYTE. |
| 21 | 18 | SLID WHEEL START TIME |
| 22 | 19 | SLID WHEEL START TIME, CONTD |
| 23 | 20 | SLID WHEEL END TIME |
| 24 | 21 | SLID WHEEL END TIME, CONTD |
| 25 | 22 | TRAIN HDLG FIRST EVENT TIME |
| 26 | 23 | TRAIN HDLG FIRST EVENT TIME, CONTD |
| 27 | 24 | TRAIN HDLG COUNT (0 - 256) |
| 28 | | FRAME CHECK SEQUENCE, MSB |
| 29 | | FRAME CHECK SEQUENCE, LSB |

FIG. 5

| MSG BYTE | DATA BYTE | DESCRIPTION |
|---|---|---|
| 0 | | START SYMBOL |
| 1 | | TO/FROM |
| 2 | | PACKET NUMBER |
| 3 | | NUMBER OF DATA BYTES |
| 4 | 1 | DATA BYTE - CAR ID, ALPHA MSB |
| 5 | 2 | - CAR ID, ALPHA |
| 6 | 3 | - CAR ID, ALPHA |
| 7 | 4 | - CAR ID, ALPHA MSB |
| 8 | 5 | - CAR ID, NUMERIC LSB |
| 9 | 6 | - CAR ID, NUMERIC |
| 10 | 7 | - CAR ID, NUMERIC |
| 11 | 8 | - CAR ID, NUMERIC |
| 12 | 9 | - CAR ID, NUMERIC |
| 13 | 10 | - CAR ID, NUMERIC |
| 14 | 11 | - BRAKE LOCATION, _, A OR B |
| 15 | 12 | DISCRETE COM - 1 = COMMAND. |
| 16 | 13 | NEW CAR ID, ALPHA MSB |
| 17 | 14 | - CAR ID, ALPHA |
| 18 | 15 | - CAR ID, ALPHA |
| 19 | 16 | - CAR ID, ALPHA MSB |
| 20 | 17 | - CAR ID, NUMERIC LSB |
| 21 | 18 | - CAR ID, NUMERIC |
| 22 | 19 | - CAR ID, NUMERIC |
| 23 | 20 | - CAR ID, NUMERIC |
| 24 | 21 | - CAR ID, NUMERIC |
| 25 | 22 | - CAR ID, NUMERIC |
| 26 | 23 | - BRAKE LOCATION , _, A OR B |
| 27 | | FRAME CHECK SEQUENCE, MSB |
| 28 | | FRAME CHECK SEQUENCE, LSB |

FIG. 6

| MSG BYTE | DATA BYTE | DESCRIPTION |
|---|---|---|
| 0 | | START SYMBOL |
| 1 | | TO/FROM |
| 2 | | PACKET NUMBER, 0 TO 8 |
| 3 | | NUMBER OF DATA BYTES |
| 4 | 1 | DATA BYTE - CAR ID, ALPHA MSB |
| 5 | 2 | CAR ID, ALPHA |
| 6 | 3 | CAR ID, ALPHA |
| 7 | 4 | CAR ID, ALPHA MSB |
| 8 | 5 | CAR ID, NUMERIC LSB |
| 9 | 6 | CAR ID, NUMERIC |
| 10 | 7 | CAR ID, NUMERIC |
| 11 | 8 | CAR ID, NUMERIC |
| 12 | 9 | CAR ID, NUMERIC |
| 13 | 10 | CAR ID, NUMERIC |
| 14 | 11 | BRAKE LOCATION, _, A OR B |
| 15 | 12 | DISCRETE COM - 1 = COMMAND. |
| 16 | | FRAME CHECK SEQUENCE, MSB |
| 17 | | FRAME CHECK SEQUENCE, LSB |

FIG. 7

| MSG BYTE | DATA BYTE | DESCRIPTION |
|---|---|---|
| 0 | | START SYMBOL |
| 1 | | TO/FROM |
| 2 | | PACKET NUMBER |
| 3 | | NUMBER OF DATA BYTES |
| 4 | 1 | DATA BYTE - CAR ID, ALPHA MSB |
| 5 | 2 | - CAR ID, ALPHA |
| 6 | 3 | - CAR ID, ALPHA |
| 7 | 4 | - CAR ID, ALPHA MSB |
| 8 | 5 | - CAR ID, NUMERIC LSB |
| 9 | 6 | - CAR ID, NUMERIC |
| 10 | 7 | - CAR ID, NUMERIC |
| 11 | 8 | - CAR ID, NUMERIC |
| 12 | 9 | - CAR ID, NUMERIC |
| 13 | 10 | - CAR ID, NUMERIC |
| 14 | 11 | - BRAKE LOCATION, _, A OR B |
| 15 | 12 | DISCRETE COM - 1 = COMMAND. |
| 16 | 13 | MINUTE(0-59) |
| 17 | 14 | HOUR(0-23) |
| 18 | 15 | DAY(1-31) |
| 19 | 16 | MONTH(1-12) |
| 20 | 17 | YEAR(0 - 99) |
| 21 | | FRAME CHECK SEQUENCE, MSB |
| 22 | | FRAME CHECK SEQUENCE, LSB |

FIG. 8

REMOTELY OPERATED RAIL CAR STATUS MONITOR AND CONTROL SYSTEM

FIELD OF THE INVENTION

The present invention relates generally to systems for monitoring and controlling the operational status of railroad or rail cars. In particular, the present invention is a remotely operable rail car status monitor and control system.

BACKGROUND OF THE INVENTION

Pneumatic air brake systems are well known and in widespread use on freight and other trains. These air brake systems include a pneumatic reservoir, brake valve and brake cylinder on each individual rail car of the train. The brake valve on each car is connected to an air brake hose which is adapted to be interconnected to the air brake hoses of adjacent cars. In effect, a common air brake hose extends the length of the train. Pneumatic braking signals are transmitted to the brake valves of the rail cars from a locomotive through the air brake hose. The brakes of all the rail cars are therefore applied and released at generally the same time, although there is a propagation delay in the pneumatic control signal which causes the brakes of the cars closer to the locomotive to be applied and released sooner than the brakes of the cars toward the end of the train. The length of these braking time differentials are directly related to the length of the train.

Electronic Air Brake Systems (EABS), also sometimes known as electronically controlled pneumatic (ECP) brake systems, are also being incorporated into trains. Braking systems of this type include a car control unit (CCU) on each rail car. The CCUs are all powered by a supply provided by a power cable extending the length of the train. Control over the CCUs is also provided by signals transmitted over the cable from the locomotive. An advantage of EABS is that they are not susceptible to brake time differentials, since the electronic control enables all the brakes to be applied and released effectively simultaneously.

Rail cars also include handbrakes which allow the brakes of the car to be manually applied and released. Handbrakes of this type are known and in widespread use. They typically include a hand-operated actuator such as a wheel or lever which is mechanically linked to the brakes by a chain or other linkage. Through use of the actuator (e.g., by rotating the wheel) an operator causes the linkage to pull the brake pads into engagement with the wheels of the car. Since individual pneumatic brakes on some cars of a train are sometimes inoperable (e.g., if the air has leaked out of the pneumatic reservoir), the handbrakes are usually set whenever the rail car is parked in a yard. Before the rail car can be moved, the handbrake must be released. The release of the handbrakes requires an operator to physically board the car.

Before a train rolls out of a yard an operator typically travels the length of the train (generally on foot or riding a motorized vehicle) and inspects each rail car. During this inspection the operator will typically observe the status of the handbrakes by looking to see if the chain or other linkage exhibits the sufficient degree of slack that would be expected in a released handbrake. If it appears that the handbrake is not released, the operator must board the car and release the handbrake since the wheels can be damaged if they slide on the track (rather than rotate) when the train moves. The operator can also monitor and control other systems on the train during this procedure. For example, the open or closed state of hoppers, the temperature of refrigerators and load weights can be monitored and controlled. However, it can be inefficient and sometimes relatively unreliable to perform these actions in this manner.

It is evident that there is a continuing need for improved rail car monitor and control procedures. A system capable of positively monitoring and controlling systems on rail cars to a high degree of accuracy with a minimum of operator intervention would be particularly desirable. Any such system should be capable of being retrofit onto existing rail car brake and other systems without interfering with the operation of the existing systems. To be commercially viable it must also be capable of being efficiently manufactured and operated.

SUMMARY OF THE INVENTION

The present invention is a remotely operable system for monitoring and controlling the status of the handbrake and/or other mechanical and electrical systems on rail cars. The system is easy to use and operates to a high degree of accuracy. It can be retrofit onto existing rail car systems and is functionally transparent to the operation of the existing systems.

One embodiment of the invention includes a transponder system adapted to be mounted to each rail car of a train, and a transportable data terminal for providing remote communications with each of the transponder systems. Each transponder system includes one or more sensors for sensing information representative of the operation of a rail car, one or more actuators for actuating systems of the rail car, a data link and a controller. The transponder data link receives transponder control commands and transmits rail car operation messages. The controller is coupled to the sensors, actuators and data link, and causes the data link to transmit operation messages representative of rail car operation, and to actuate the actuators, as a function of transponder control commands received by the data link. The data terminal includes a display, an operator-actuated input device, a data link and a controller. Using the input device an operator can select transponder control commands. The data link transmits the transponder control commands to, and receives operation messages from, the transponder systems. The data terminal controller causes the data link to transmit selected transponder control commands to the transponders, and causes information representative of rail car operation to be displayed on the display as a function of the received operation messages.

BRIEF DESCRIPTION OF THE DRAWINGS

FIG. 5 is a table describing the data transmission format between the HSRMs and HDT shown in FIG. 1.

FIG. 6 is a table describing the ID code data transmission format between the HDT and HSRMs shown in FIG. 1.

FIG. 7 is a table describing the data transmission format of Release, Clock Read, Slid Wheel Clear, and Train Hdlg function commands between the HDT and HSRMs shown in FIG. 1.

FIG. 8 is a table describing the data transmission format of a Clockset command between the HDT and HSRMs shown in FIG. 1.

DETAILED DESCRIPTION OF THE PREFERRED EMBODIMENTS

Figure 1:
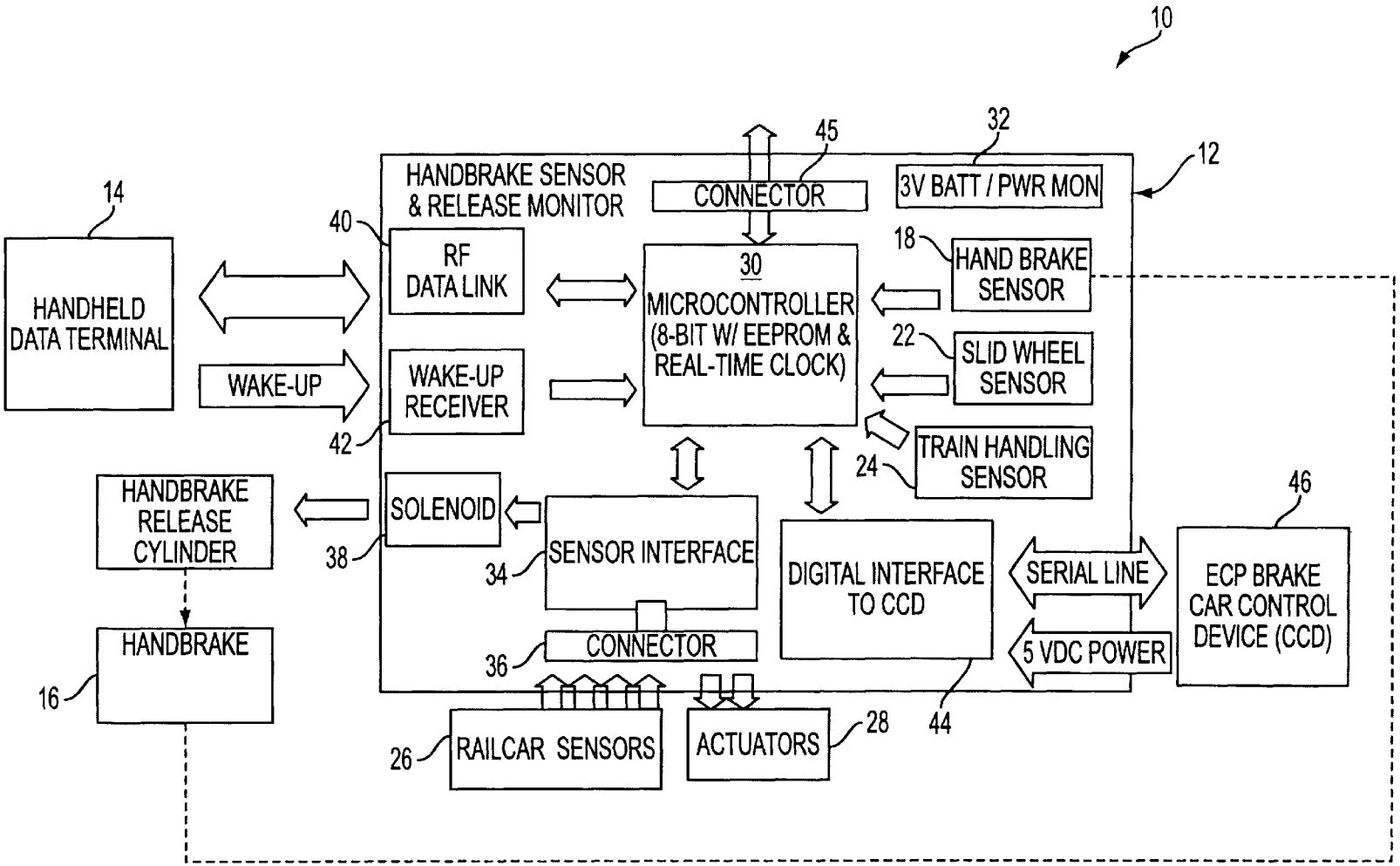
FIG. 1 is a block diagram of a rail car monitor and control system in accordance with the present invention interconnected to a handbrake, with the handbrake sensor and release monitor (HSRM) shown in detail.

A remotely operable rail car status monitor and control system 10 in accordance with the present invention is illustrated generally in FIG. 1. System 10 includes a plurality (only one is illustrated) of handbrake sensor and release monitors (HSRMs) 12 configured for radio frequency (RF) communication with a handheld data terminal (HDT) 14. Each HSRM 12 is adapted to be mounted to an individual rail car of a freight or other train (not shown), and is interfaced to mechanical, electrical or other systems and components of the rail car. Each rail car of a train making use of system 10 will preferably include an HSRM 12. HSRM 12, for example, monitors and controls the operational status or state of the rail car handbrake 16. Information representative of the operational state of the handbrake 16 (i.e., whether the handbrake is applied (set) or released) is obtained by sensor 18. The handbrake 16 also can be released by HSRM 12 through actuation of a handbrake release cylinder 20. By interfacing with HSRM 12 through HDT 14, an operator can remotely monitor the operational state of the handbrake 16 and, if desired, remotely release the handbrake. These operations can be performed conveniently, effectively and accurately, thereby enhancing the overall efficiency of train operation.

A wide variety of other mechanical, electrical or other systems and components of rail cars can also be monitored through the use of system 10. Examples included load weight, wheel bearing temperature, car utilization, refrigerator temperature security sensor states, hopper door, ride quality and bearing health. Operating characteristics of the train can also be monitored. By way of example, and as described in greater detail below, the illustrated embodiment of HSRM 12 includes a slid wheel sensor 22 and a train handling sensor 24. Slid wheel sensor 25 enables the HSRM to identify, record and provide information on slid wheel events. Information representative of train handling impact or bump events can be identified, recorded and provided to an operator through the use of train handling sensor 24. Similarly, a wide variety of mechanical, electrical and other systems and components of rail cars can be controlled through the use of system 10. In addition to the actuation of the handbrake 16, examples include the refrigeration unit temperature control. The actuators shown generally at 28 can be controlled by the HSRM 12 for these purposes. Parameters such as rail car operating characteristics and the status of the rail car and its on-board systems can all generally be referred to as rail car operational or operating characteristics.

The overall operation of HSRM 12 is controlled by a programmed microcontroller 30 having associated memory and a real time clock (not separately shown). A unique identification code corresponding to the alpha-numeric identifier printed on the rail car to which it is mounted is programmed into the memory. The handbrake sensor 18, slid wheel sensor 22 and train handling sensor 24 are all shown interfaced directly to the microcontroller 30. Sensors 26 and actuators 28 are interfaced to the microcontroller 30 through a sensor interface 34 (e.g., a signal conditioner and analog-to-digital converter) and connector 36. The solenoid 38 for actuating the handbrake release cylinder 20 is interfaced to the microcontroller 30 through the sensor interface 34 in the illustrated configuration of HSRM 12. Power is provided and monitored by a supply 32 which in one embodiment includes a 3.3VDC lithium thionyl-chloride battery (not separately shown). Although the battery power supply 32 is the only or sole power supply in the illustrated embodiment, other embodiments (not shown) can be powered from other sources such as the CCU or from a supply provided from the locomotive. RF data communications between the HSRM 12 and HDT 14 are provided by an RF data link 40 coupled to the microcontroller 30. As described in greater detail below, HSRM 12 is programmed to operate in a number of different modes. When inactive, the HSRM 12 will be in a power-conserving inactive or Sleep state. The HDT 14 initiates communications with the HSRM 12 and causes the HSRM to operate in a Normal state through the transmission of wake-up commands detected by a wake-up receiver 42. In the preferred embodiment shown, an RS 485 compatible digital interface 44 is included to enable the microcontroller 30 to interface to a conventional ECP brake car control device (CCD) 46. The initial operating software of program and subsequently issued updates for HSRM 12 can be loaded into the memory of microcontroller 30 through an RS 232 interface 45.

The above-described components of HSRM 12 are packaged in a weather-tight enclosure which is configured to be mounted directly to the operator-actuated wheel or lever assembly (not separately shown) of a conventional chain-type rail car handbrake 16. In one embodiment the handbrake sensor 18 is a microswitch which senses the position of the chain take-up on handbrake 16. By way of example, in an embodiment of this type the microswitch can be mounted with respect to the chain take-up and set up to be in an open electrical state indicating a released handbrake 16 if the take-up is at a position corresponding to the presence or two or more inches of slack in the chain. If less than two inches of slack are present, the microswitch will be switched to an electrically closed state indicating that the handbrake 16 is set or applied. Other types of sensors 18 and conventions for determining the released and applied states of the handbrake 16 can of course also be used. A solenoid 38 for actuating a valve (not separately shown) of a pneumatic release cylinder 20 mounted to the handbrake 16 can be used to drive the handbrake to its released state. These characteristics of HSRM 12 enable the device to be retrofit to existing rail car systems. HSRM 12 is also functionally transparent to the existing systems and to the operators in that it permits the systems to operate in their conventional manner without interference from the HSRM (e.g, the handbrake 16 can still be operated by hand to release and apply the brake).

Slid wheel sensor 22 can be implemented as an acceleration switch set up to detect motion of HSRM 12 at levels greater than a predetermined slid wheel threshold level such as 1.5 g. In this particular embodiment the microcontroller 30 is programmed to identify slid wheel events as a function of the output of the acceleration switch and the handbrake sensor 18. For example, the microcontroller 30 can be programmed to transition from its Sleep state to its Normal state when motion greater than the slid wheel threshold level is sensed and the handbrake sensor 18 indicates that handbrake 16 is in its applied state. After a motion sensing delay of, for example, 30 seconds, the HSRM 12 will monitor the slid wheel sensor 22 and count the number of acceleration events greater than the slid wheel threshold level (e.g., switch closures) during a subsequent predetermined motion sensing period such as 20 seconds. HSRM 12 detects or identifies a valid slid wheel event if under these circumstances the count exceeds a predetermined number such as 200. The date and time of the first detected slid wheel event are then recorded in memory, after which the HSRM 12 transitions back to its Sleep state. Slid wheel event sensing can then be disabled for a delay period such as 3600 seconds. The identification of second and subsequent slid wheel events are similarly recorded, but the time of the events is not recorded in one embodiment. Other sensors 22 and algorithms can also be used to identify and record slid wheel events.

Train handling sensor 24 can be implemented as an acceleration switch set up to detect motion of HSRM 12 at levels greater than a predetermined train handling impact threshold such a 5 g. In an embodiment of this type, the HSRM 12 can be programmed to transition from its Sleep state to its Normal state when impacts greater than the train handling threshold are detected. The date and time of the first detected train handling impact event are then recorded in memory, after which the HSRM transitions back to its Sleep state. The identification of second and subsequent train handling impacts are similarly recorded (e.g., by incrementing a counter), but the time of the events is not recorded in one embodiment. Other sensors 24 and algorithms can also be used to identify and record train handling impact events.

The above-described use of a microswitch for sensor 18 and acceleration switches for sensors 22 and 24 enables the associated sensed events to be monitored and detected without power requirements for the sensors themselves. HSRMs 12 can thereby effectively monitor these states without drawing significant power from the supply 32.

RF data link 40 is configured to communicate with the hand held data terminal 14 by packetized On-Off keyed (i.e., digital) transmissions at 916.5 MHz in a preferred embodiment of the invention. FIG. 5 is a table describing the transmission format of the data transmissions generated by a preferred embodiment of HSRMs 12. Similarly, wake-up receiver 42 is configured to receive wake-up commands from the HDT 14 at 916.5 MHz. The wake-up command is a single pulse in one embodiment of the invention, and therefore capable of simultaneously "waking up" all the HSRMs 12 within its range. Upon the detection of a wake-up command by receiver 42, microcontroller 30 transitions from its Sleep state to its Normal state. In one embodiment the HDT 14 is configured to be capable of waking-up the multiple HSRMs 12 at a distance of up to about 30 feet. The two-way communication range between the HSRMa 12 and HDT 14 will generally be about equal to or greater than the wake-up range.

Figure 2:
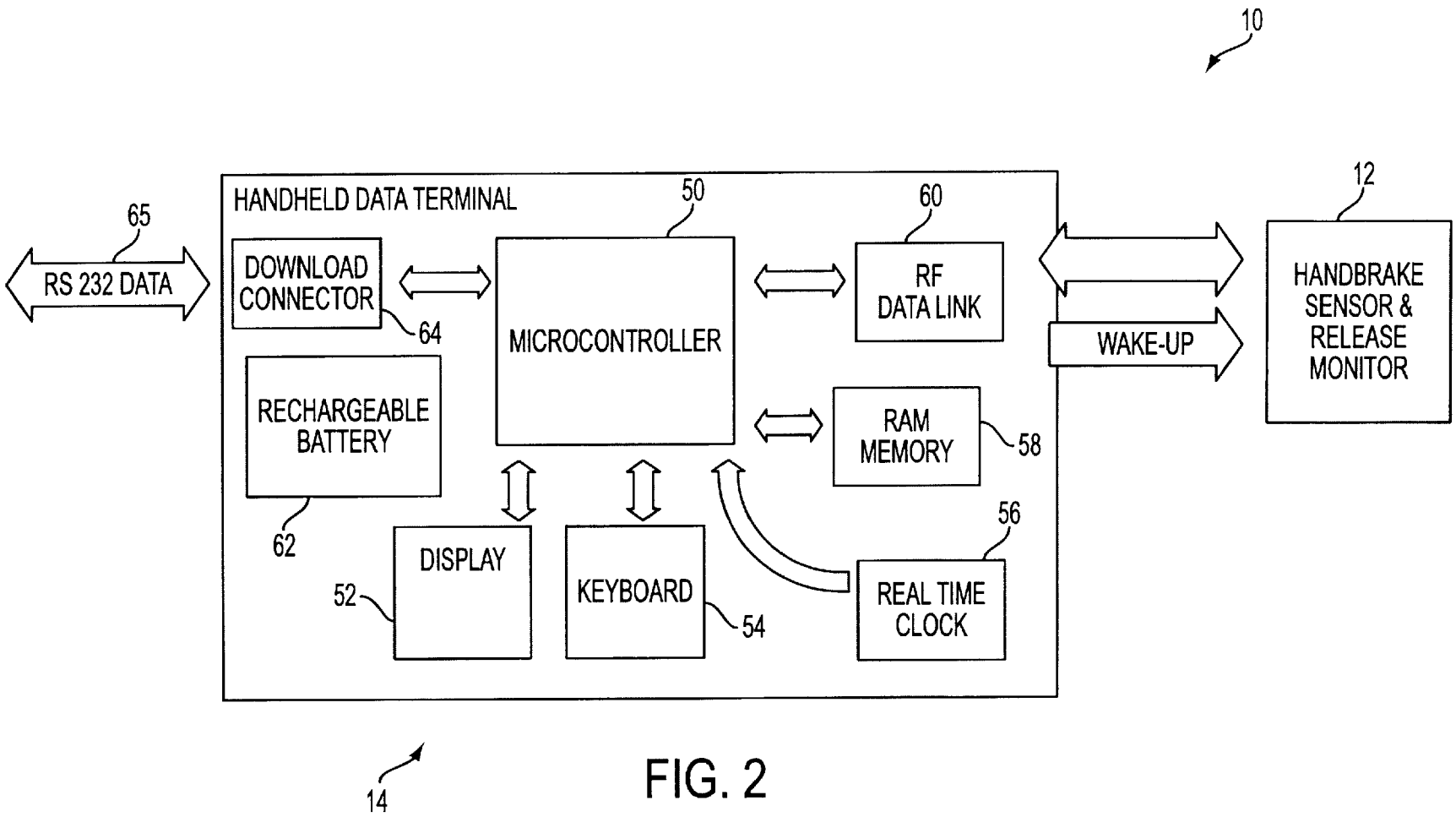
FIG. 2 is a detailed block diagram of the handheld data terminal (HDT) of the system shown in FIG. 1.
Figure 3:
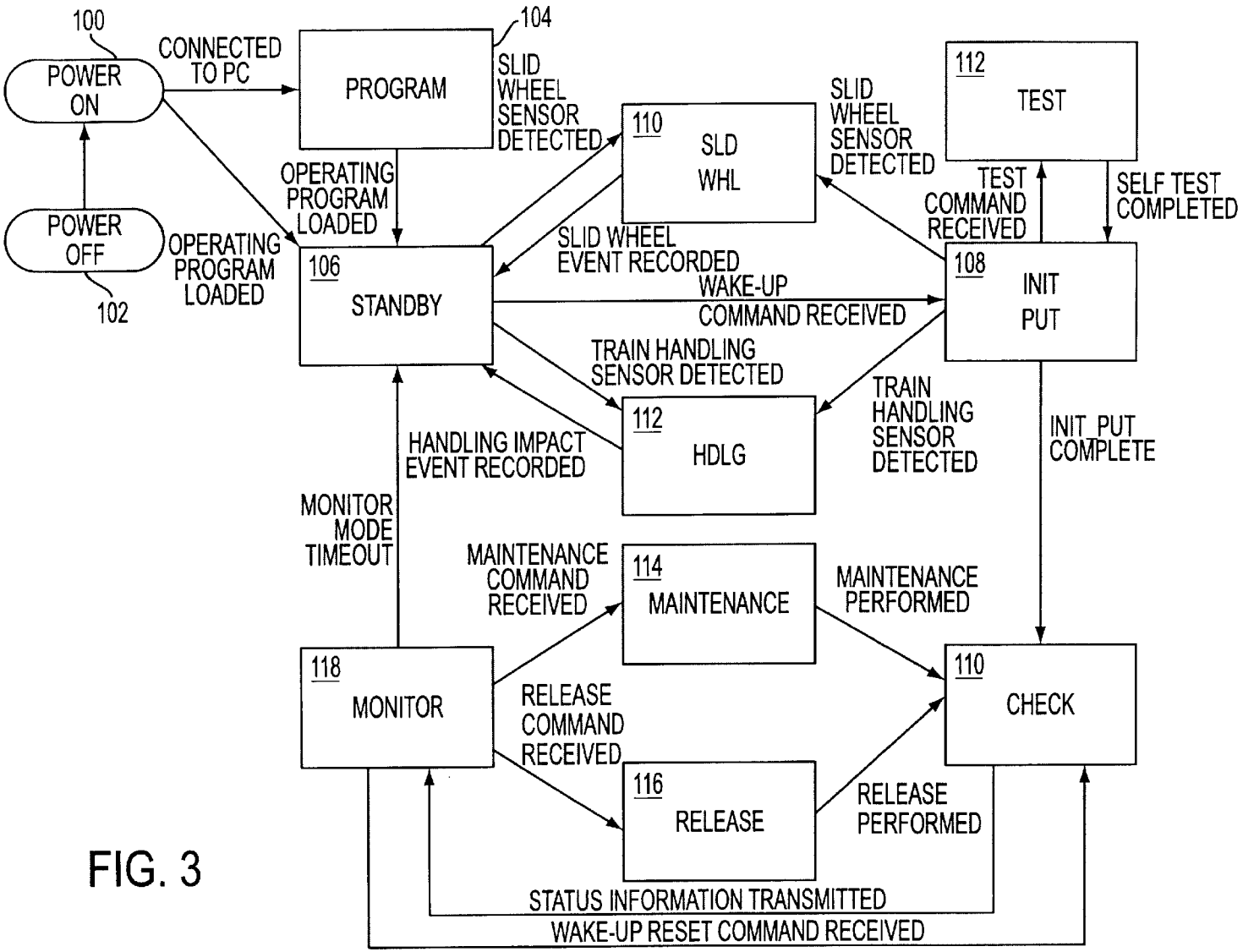
FIG. 3 is a state diagram illustrating the operating modes of the HSRM shown in FIG. 1.

HDT 14 is used by an operator to retrieve data from and transmit data to all the HSRMs 12 of a train, and can be described in greater detail with reference to FIG. 2. The overall operation of data terminal 14 is controlled by a microcontroller 50. A visual display 52, keyboard 54, real time clock 56 and random access memory (RAM) 58 are all interfaced to the microcontroller 50. Display 52 is a four line by twenty character LCD display in one embodiment. Keyboard 54 can be a conventional nine button type device which includes Select, Enter, Up arrow, Down arrow, Right arrow, Left arrow and Function keys (not separately shown). RF communications with the HSRMs 12, including both the receipt and transmission of data and the transmission of wake-up and function commands, is provided by RF data link 60 which in the preferred embodiment is an on-off keyed device operating at a frequency of 916.5 MHz. FIG. 6 is a table describing the format of car ID codes transmitted to the HSRMs 12 by one preferred embodiment of the HDT 14. FIG. 7 is a table describing the format of the Release, Clock Read, Slid Wheel Clear, and Train Hdlg (handling) function commands (described below) transmitted to the HSRMs 12 by a preferred embodiment of HDT 14. A table describing the format of data transmitted to HSRMs 12 to perform the Clockset function described below is illustrated in FIG. 8. Power for the HDT 14 is provided by a rechargeable 7.2VDC battery 62. The HDT 14 can be programmed from, and stored information received from the HSRMs 12 downloaded to, a conventional PC or other computer through a download connector 64 (e.g., in RS 232 format). All the above-described components of HDT 14 are packaged in a weather tight enclosure (not separately shown).

Figure 4:
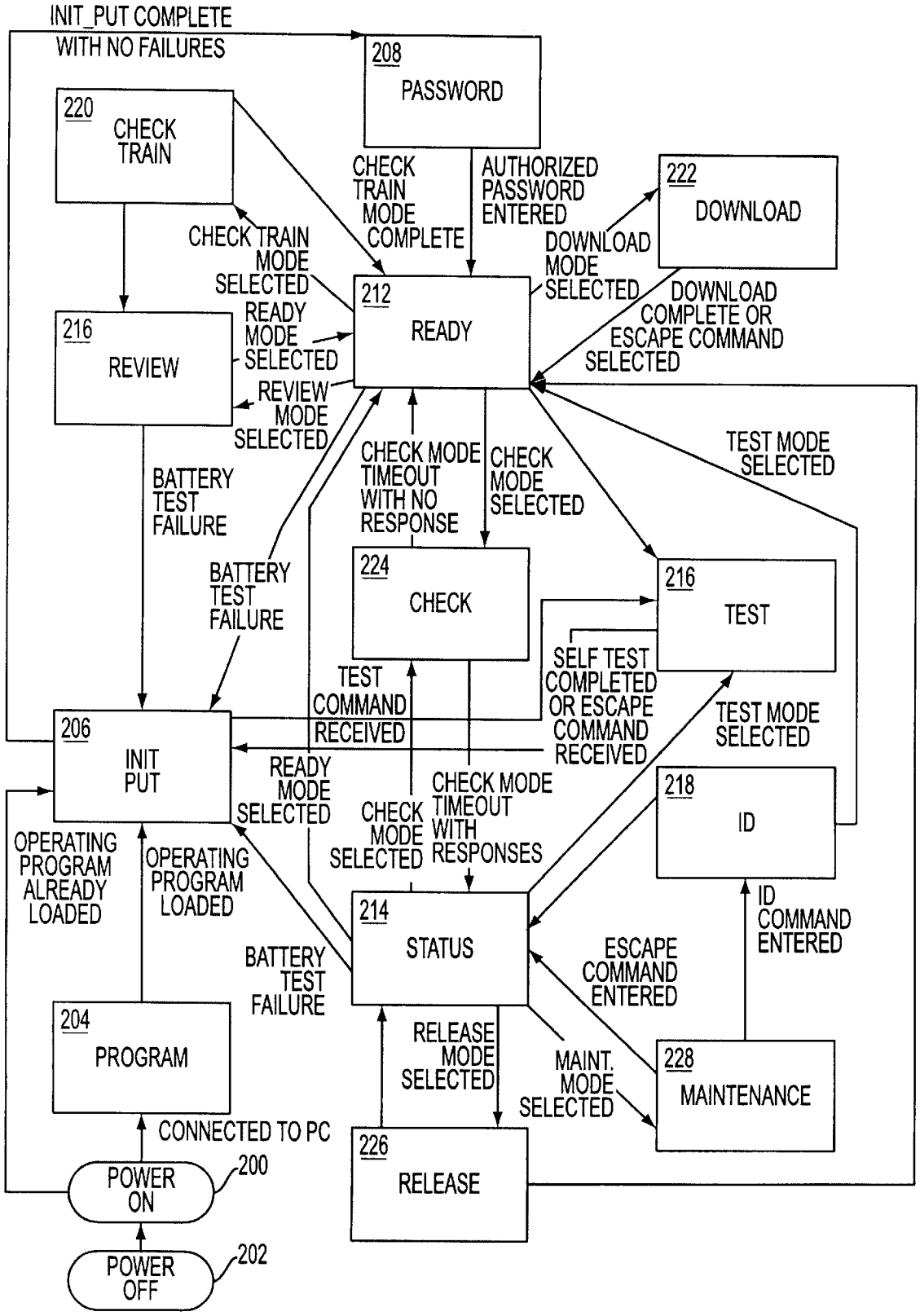
FIG. 4 is a state diagram illustrating the operating modes of the HDT shown in FIG. 2.

The programmed operational modes of a preferred embodiment of the HSRMs 12 can be described with reference to FIGS. 1 and 4. Upon initial setup, the HSRM 12 will switch to a Power On condition 100 from a Power Off condition 102 when the batteries of supply 32 are loaded into the device. Once in the Power On condition 100, the HSRM 12 will switch to its Program mode 104 if the device is connected to a PC or other programming source (e.g., through the interface 45). The operating program described herein can be downloaded into the HSRM 12 (i.e., into memory of the microcontroller 30) during operation in the Program mode 104. After the operating program is loaded into the HSRM 12 during the Program mode 104, or immediately following a switch to the Power On condition 100 if the operating program has already been loaded, the device will switch to Standby mode 106.

HSRM 12 operates in its Standby mode 106 when the device is in its Sleep state. While in the Standby mode 106 the microcontroller 30 is interrupt-driven, and power is applied to only essential functions such as the real time clock and memory of the microcontroller, and to monitoring components such as wake-up receiver 42. Battery power of supply 32 is thereby conserved. While in the Standby mode 106 the microcontroller 30 monitors: 1) the receipt of wake-up commands from receiver 42, 2) the receipt of signals from slid wheel sensor 22 indicating that an acceleration greater than the slid wheel threshold was detected (slid wheel threshold signals), 3) the receipt of signals from the train handling sensor 24 indicating that an acceleration greater than the train handling impact threshold was sensed (impact threshold signals) and 4) the operational state of the handbrake sensor 18. If a wake-up command is received, HSRM 12 begins operation in its Normal state in the Init_PUT (initialization, power up test) mode 108. If a slid wheel threshold signal is received and the handbrake sensor 18 indicates that that handbrake 16 is in the brake applied state, the HSRM 12 switches to operation in the Sld_Whl (slid wheel) mode 110. Operation in the Hdlg (handling) mode 112 is initiated when an impact threshold signal is received.

HSRM 12 performs a number of initialization and power up functions in the Init_PUT mode 108. Examples of the power up tests which can be performed include memory sum check and memory tests. Initialization functions that are performed include the incrementing of a counter dedicated to counting the number of times the HSRM transitions from its Sleep state to its Normal state (wake-up events) and resetting event duration (watchdog or timeout) timers. Once the initialization functions and power up tests are completed, successfully or not, the HSRM 12 switches to operation in the Check mode 110.

A relatively comprehensive self test can be performed by HSRM 12 in the Test mode 112. Test mode 112 is entered from the Init_PUT mode 108 upon the receipt of a Test command from the hand held HDT 14. Examples of tests performed by the HSRM 12 during the Test mode operation include power supply, data transmission and handbrake release tests. After completing operation in the Test mode 112, the HSRM 12 returns to the Init_PUT mode 108.

If during operation in either the Standby mode 106 or the Init_PUT mode 108 a slid wheel threshold signal is provided by sensor 22 while the handbrake sensor 18 indicates that the handbrake 16 is applied, HSRM 12 initiates operation in the Sld_Whl mode 110. During operation in the Sld_Whl mode 110, the HSRM 12 performs the slid wheel event detection and recording operations described above. The HSRM 12 returns to operation in the Standby mode 106 following the Sld_Whl mode 110 operation.

If during operation in either the Standby mode 106 or the Init_PUT mode 108 the train handling sensor 24 generates an impact threshold signal, HSRM 12 initiates operation in the Hdlg mode 112. During operation in the Hdlg mode 112, the HSRM 12 performs the train handling impact event detection and recording operations described above. The HSRM 12 returns to operation in the Standby mode 106 following the Hdlg mode 112 operation.

Check mode 110 operation is initiated after the initialization and power up tests of Init_PUT mode 108 are completed. As described below, the Check mode 110 is also be initiated following operation in the Maint (maintenance) mode 114 and the Release mode 116. In the Check mode 110, HSRM 12 reads from the memory of microcontroller 30 the following information:

1. Status (states) of sensors 18, 22, 24 and 26.
2. Status of supply 32.
3. Rail car ID.
4. Wake-up count.
5. Release count.
6. First slid wheel event time.
7. First train handling impact event time. In effect, all the stored and other current information characterizing the operational status of the rail car monitored by the HSRM 12, including the mechanical, electrical and other systems, is collected. This rail car status information data is then formatted and transmitted to the HDT 14 by data link 40.

After the rail car status information data is transmitted to the HDT 14, HSRM 12 begins operation in the Monitor mode 118. While operating in the monitor mode 118 the HSRM 12 monitors the data link 40 for function commands received from HDT 14. Any received commands are validated by comparing the car ID present in the command to the stored car ID of the HSRM 12. Validated commands are then initiated.

In the preferred embodiment described herein the types of function commands that can be received from the HDT 14 include a Release command or one of a set of Maintenance commands. If a Maintenance command is received, the HSRM 12 begins operation in the Maint mode 114. Operation in the Release mode is initiated when a Release command is received.

Examples of the types of Maintenance commands that can be received and processed in the Maint mode 114 by the embodiment of the HSRM 12 described herein include the following:

1. ID.
2. Clock Set.
3. Clock Read.
4. Slid Wheel Clear.
5. Hdlg (handling) Clear.

When performing an ID command in the Maint mode 114 the HSRM 12 changes the stored car ID to the ID provided in the data transmitted with the command. The real time clock of the microcontroller 30 is set to the value transmitted with the command, and the new time inserted into the first slid wheel event time memory, when a Clock Set command is received. The real time clock of the microcontroller 30 is read, and the received clock reading inserted into the first slid wheel event time memory, when a Clock Read command is received. Stored slid wheel event data is cleared from the memory of microcontroller 30 and the slid wheel event interrupt of the microcontroller is enabled in response to Slid Wheel Clear commands. Similarly, train handling impact event data is cleared from the memory of microcontroller 30 and the train handling impact event interrupt of the microcontroller is enabled in response to Hdlg Clear commands. After the completion of these and any other Maintenance commands performed by the HSRM 12 during the Maint mode 114 operation, the device switches to operation in the Check mode 110.

In response to the receipt of Release commands from the HDT 14, HSRM 12 operates in the Release mode 116 by actuating the solenoid 38 to release handbrake release cylinder 20. A release count stored in the memory of microcontroller 30 is then incremented before the HSRM 12 initiates data transmission in the Check mode 110.

From the Monitor mode 118 the HSRM 12 can also switch directly to operation in the Check mode 110 or the Standby mode 106. As shown in FIG. 4, operation in the check mode 110 is initiated if a wakeup reset command is received by the receiver 42 while the HSRM is operating in the Monitor mode 118. HSRM 12 switches from the Monitor mode 118 to the Standby mode 106 when a monitor mode timeout occurs. Although not described above, timeout escape periods are set and monitored during the other operating modes of HSRM 12.

The operational modes in which a preferred embodiment of the HDT 14 are programmed to operate can be described with reference to FIGS. 2 and 5. Upon initial setup, the HDT 14 will switch to a Power On condition 200 from a Power Off condition 202 when the battery 62 is loaded into the device. Once in the Power On condition 200, the HDT 14 will switch to its Program mode 204 if the device is connected to a PC or other programming source (e.g., through the download connector 64). The operating program described herein can be downloaded into the HDT 14 (i.e., into memory 58) during Program mode 204 operation. After the operating program is loaded into the HDT 14, or immediately following a switch to the Power On condition 200 if the operating program has already been loaded, the device will switch to Init_PUT (initialization, power up test) mode 206.

HDT 14 performs a number of initialization and power up functions in the Init_PUT mode 206. Examples of the power up tests which can be performed include check sum and other memory tests, a test of the real time clock 56 and test of battery 62 and data link 60. If the initialization and power up tests are completed and no failures are identified, the HDT 14 transitions to operation in the Password mode 208. HDT 14 will also begin operation in the Init_PUT mode 206 if a battery test failure occurs during operation in the Ready mode 212, the Status mode 214 or the Review mode 216.

A relatively comprehensive self test can be performed by HDT 14 in the Test mode 210. Test mode 210 is entered from the Init_PUT mode 206 upon the receipt of a Test command from the keyboard 54 of the HDT 14. Examples of tests performed by the HDT 14 during the Test mode 210 operation include wake-up command, transmission function and memory tests. After completing operation in the Test mode 210, the HDT 14 returns to operation in the Init_PUT mode 206. HDT 14 will also return to operation in the Init_PUT mode 206 from the Test mode 210 if an Escape command from the keyboard 54 is received during operation in the Test mode.

In the Password mode 208 the operator is prompted through display 52 to enter a password into the HDT 14 through the use of keyboard 54. The preferred embodiment of the HDT described herein makes use of two passwords (i.e., has two security levels). Password 1 (PW1) allows the operator access to all the described operating modes of the HDT 14 with the exception of the ID mode 218 described below. Password 2 (PW2) allows the operator access to all the operating modes of HDT 14. The entered password is compared by the HDT 14 to previously entered and stored values for the PW1 and PW2. If the password entered by the operator in response to the prompt matches either the stored PW1 or PW2, the operator is granted the associated authorization level and the HDT 14 begins operation in the Ready mode 212. If the entered password is invalid, an "Invalid, Reenter" message is presented on display 52, and the above-described steps repeated until an authorized password is entered or the HDT is switched to its Power Off condition 202.

In the Ready mode 212 the operator is prompted through display 52 to use the keyboard 54 to select one of several operating modes (i.e., to perform desired functions). In the preferred embodiment described herein the prompted mode changes include:

1. Chk-Train (check train) mode.
2. Review mode.
3. Down-Load mode.
4. Check mode.
4. Clockset mode.

If the Chk-Train mode 220, Review mode 216, Down-Load mode 222 or Check mode 224 are selected, the HDT 14 will operate in these modes in the manner described below. If the Clockset mode (not shown in FIG. 5) is selected, the display 52 will prompt the operator to enter the current date and time to set real time clock 56.

HDT 14 also periodically performs a status check of the battery 62 while operating in the Ready mode 212. If a battery test should indicate a failure, the HDT 14 will transition to operation in the Init_PUT mode 206.

Check mode 224 operation is selected by an operator when it is desired to wake up an individual HSRM 12 and receive a car status data transmission from the HSRM. Upon receipt of a wake-up command all responding HSRMs 12 delay responsive transmissions by a random time period to facilitate the receipt of all the transmissions by the HDT 14. The transmissions from HSRMs 12 are repeated at least several times until an acknowledgment is received from the HSRM. During this Check mode 224 the HDT 14 transmits a wake-up command and all HSRMs 12 which wake-up will respond. The operator can then select the desired HSRM 12. The car status data received from the HSRM 12 is tabulated by the HDT 14 and presented to the operator on display 52. If valid responses were received from the HSRMs 12 during the Check mode 224, the HDT 14 will transition to operation in the Status mode 214 following the completion Check mode operation . If no valid responses were received from the HSRMs 12 during the Check mode 224, the HDT 14 will display a "No Valid Response" message and switch to operation in the Ready mode 212 following Check mode operation.

Chk-Train mode 220 operation is selected by an operator when it is desired to wake up and receive a car status data transmission from all the HSRMs 12 of a train. As the operator travels the length of the train (e.g., walking or on a motorized vehicle) the HDT 14 repeatedly transmits wake-up commands. The car status data received from the HSRMs 12 is then tabulated by the HDT 14 and presented to the operator on display 52. After the car status information is tabulated, it can be presented to the operator in a number of different formats. For example, the car status information can be displayed sequentially to the operator in the reverse order of the cars on the train. As the operator travels the length of the train a second time, and in the opposite direction as during the monitoring operation, the status of each car can be presented on the display 52. Other options are to have the HDT 14 display only the status of the handbrakes 16, or alerts identifying only the handbrakes 16 which are not in the desired state (e.g, are set when the train is about to depart or released when parked). After operation in the Chk-Train mode 220, HDT 14 will switch to the Review mode 216 if the Chk-Train mode was selected by the operator, or back to the Ready mode 212 if Review mode operation was commanded and there is not stored data (stored data is erased after operation in the Chk-Train mode).

The types of information that can be presented on display 52 in Status mode 214 include the following:

1. Handbrake status messages.
2. System (e.g., data terminal and HSRM) status messages.
3. Slid wheel event data.
4. Train handling impact event data.
5. Maintenance data.

Car selection during Status mode 214 operation can be performed by scrolling through use of the keyboard 54. While in the Status mode 214 an operator can also use the keyboard 54 to select operation in the Check mode 224, Release mode 226, Ready mode 212, Maint mode 228 and Test mode 210. HDT 14 also periodically monitors the status of battery 62 during Status mode 214 operation, and switches to operation in the Init_PUT mode 206 if a failure is identified.

While in the Review mode 216 the operator can use the keyboard 54 to select operation in the Ready mode 212. In the event of a battery test failure, the HDT 14 will switch to operation in the Init-PUT mode 206.

Release mode 226 is selected by an operator when it is desired to release the handbrake 16 on one or more rail cars. While operating in the Release mode 226 the HDT 14 generates a Release command which is transmitted to the HSRM 12 by data link 60.

Car status data retrieved from the HSRMs 12 and stored in the HDT 14 can be downloaded to a PC through download connector 64 when the data terminal is operated in the Download mode 222. The Download mode 222 is selected by an operator through keyboard 54 from the Ready mode 212. Upon completion of the car status information download, or if an Escape command is entered into the keyboard 54, the HDT 14 will return to operation in the Ready mode 212.

Maint (maintenance) mode 228 is used to initiate a number of maintenance functions in the HSRMs 12. For example, when operated in the Maint mode 228 the HDT 14 can send to the HSRM 12 Slid Whl Clear commands which will cause the HSRM to clear its memory locations for storing data representative of detected slid wheel events. Train Handling Clear commands which will cause the HSRM to clear the memory locations in which data representative of detected handling impacts is stored can also be transmitted by the HDT 14 when operating in the Maint mode 228. Clockset and Clock Read commands can also be transmitted to the HSRM 12 by the HDT 14 when operating in the Maint mode 228. The operator can exit the Maint mode 228 and return to the Status mode 214 by entering an Escape command through the keyboard 54. Alternatively, the operator can initiate operation in the ID mode 218 by entering an ID command into the keyboard 54.

ID mode 54 will be selected and used by an operator to enter or modify the rail car ID code programmed in HSRMs 12. The desired ID code is entered into the data terminal through the keyboard 54 and transmitted to the desired HSRM 12. After the HSRM 12 ID code is programmed in this manner, the HDT 14 will return to operation in the Ready mode 212. An operator can also return to the Status mode 214 from the Maint mode 228 by using the keyboard 54 to enter an Escape command.

Monitor and control system 10 greatly enhances railroad operations. Through the use of the system an operator can monitor and control to a high degree of accuracy the state of the handbrake and other mechanical and electrical systems of a train. Operational characteristics such as slid wheel events and train impact events can be identified to a high degree of accuracy as well. The ability to provide these functions remotely (i.e., without requiring a physical presence on the train) is especially desirable. The system is efficient to implement. The system can also be effectively and efficiently mounted to existing components (e.g., handbrakes) of rail cars.

Although the present invention has been described with reference to preferred embodiments, those skilled in the art will recognize that changes can be made in form and detail without departing from the spirit and scope of the invention. In particular, the specific operating modes, algorithms and functions described herein are only examples of the types of operating modes, algorithms and functions which can be implemented in the invention. Furthermore, although the described embodiment is implemented with programmed microcontrollers, other hardware implementations, including discrete electronic components, can be used as well.

What is claimed is:

1. A remotely operable rail car monitor and control system, comprising:

a plurality of transponder systems, each adapted to be mounted to a rail car and including:

one or more sensors for sensing information representative of the operation of the rail car;

one or more actuators for actuating systems of the rail car;

a data link for receiving transponder control commands and for transmitting rail car operation messages; and a controller coupled to the sensors, actuators and data link, for causing the data link to transmit operation messages representative of rail car operation, and to actuate the actuators, as a function of transponder control commands received by the data link; and a transportable data terminal for providing remote communications with each of the transponder systems, comprising:

a display;

an operator-actuated input device for enabling an operator to select transponder control commands;

a data link for transmitting transponder control commands to, and receiving operation messages from, the transponder systems; and a controller coupled to the display, operator-actuated input device and data link, for causing the data link to transmit selected transponder control commands to the transponders, and for causing information representative of rail car operation to be displayed on the display as a function of the received operation messages.

2. The rail car monitor and control system of claim 1 wherein the data links of the transponder systems and the data link of the data terminal are RF data links.

3. The rail car monitor and control system of claim 2 wherein the data links of the transponder systems and the data link of the data terminal are digital RF data links.

4. The rail car monitor and control system of claim 1 wherein the transponders are battery-powered.

5. The rail car monitor and control system of claim 4 wherein the transponders are solely battery powered.

6. The rail car monitor and control system of claim 4 wherein at least some of the sensors draw no battery power while sensing information representative of the operation of the rail car.

7. The rail car monitor and control system of claim 1 wherein:

the data terminal input device enables an operator to select transponder wake-up commands for transmission by the data link; and the transponder controllers operate in an inactive, power-conserving sleep state while the sensors sense information representative of the operation of the rail cars, and operate in an active, normal state in response to the receipt of wake-up commands while causing the operation messages to be transmitted and actuating the actuators.

8. The rail car monitor and control system of claim 7 wherein the transponder controllers include memory for storing information representative of the operation of the rail cars.

9. The rail car monitor and control system of claim 1 wherein:

each transponder has a unique ID code;

the operation messages transmitted by the transponders include the transponder ID code; and the data terminal controller causes the transponder ID code to be displayed on the display with the information representative of the rail car operation.

10. The rail car monitor and control system of claim 1 wherein:

the transponder sensors include handbrake state sensors;

the data terminal input device enables an operator to select handbrake state control commands for transmission by the data link;

the transponder controllers cause the data links to transmit handbrake state operation messages in response to the receipt of handbrake state commands; and the data terminal controller causes the display to display information representative of the handbrake state as a function of received handbrake state operation messages.

11. The rail car monitor and control system of claim 10 wherein:

the transponder actuators include handbrake release actuators;

the data terminal input device enables an operator to select handbrake release control commands for transmission by the data link, and the transponder controllers cause the handbrake release actuators to release the handbrakes in response to the receipt of handbrake release control commands.

12. The rail car monitor and control system of claim 1 wherein:

the transponder actuators include handbrake release actuators;

the data terminal input device enables an operator to select handbrake release control commands for transmission by the data link; and the transponder controllers cause the handbrake release actuators to release the handbrakes in response to the receipt of handbrake release control commands.

13. The rail car monitor and control system of claim 1 wherein:

the transponder sensors include slid wheel sensors for detecting slid wheel events;

the data terminal input device enables an operator to select slid wheel control commands for transmission by the data link;

transponder controllers cause the data links to transmit slid wheel event operation messages in response to the receipt of slid wheel control commands; and the data terminal controller causes the display to display information representative of the slid wheel events as a function of received slid wheel event operation messages.

14. The rail car monitor and control system of claim 13 wherein the slid wheel sensors include acceleration sensors for sensing transponder acceleration.

15. The rail car monitor and control system of claim 14 wherein:

the transponder sensors further include handbrake state sensors for sensing handbrake states; and the transponder controllers identify slid wheel events as a function of the sensed transponder acceleration and the sensed handbrake state.

16. The rail car monitor and control system of claim 1 wherein:

the transponder sensors include train handling impact sensors for detecting train handling impact events;

the data terminal input device enables an operator to select train handling impact control commands for transmission by the data link;

the transponder controllers cause the data links to transmit train handling impact event operation messages in response to the receipt of train handling impact control commands; and the data terminal controller causes the display to display information representative of the train handling impact events as a function of received train handling impact event operation messages.

17. The transponder of claim 1 wherein:

the transponder sensors include a handbrake state sensor; and the transponder controller causes the data link to transmit handbrake state operation messages in response to the receipt of handbrake state commands.

18. The transponder of claim 17 wherein:

the transponder actuators include a handbrake release actuator; and the transponder controller causes the handbrake release actuator to release the handbrake in response to the receipt of handbrake release control commands.

19. The transponder of claim 1 wherein:

the transponder sensors include a train handling impact sensor for detecting train handling impact events; and the transponder controller causes the data link to transmit train handling impact event operation messages in response to the receipt of train handling impact control commands.

20. A transponder for communication with a transportable data terminal in a remotely operable rail car monitor and control system, the transponder adapted to be mounted to a rail car and including:

one or more sensors for sensing information representative of the operation of the rail car;

one or more actuators for actuating systems of the rail car;

a data link for receiving transponder control commands and for transmitting rail car operation messages; and a controller coupled to the sensors, actuators and data link, for causing the data link to transmit operation messages representative of rail car operation, and to actuate the actuators, as a function of transponder control commands received by the data link.

21. The transponder of claim 20 wherein the data link is an RF data link.

22. The transponder of claim 21 wherein the data link is a digital RF data link.

23. The transponder of claim 20 and further including a battery power supply.

24. The transponder of claim 23 wherein the battery power supply is the sole power supply.

25. The transponder of claim 23 wherein at least some of the sensors draw no battery power while sensing information representative of the operation of the rail car.

26. The transponder of claim 20 wherein the controller includes memory for storing information representative of the operation of the rail cars.

27. The transponder of claim 20 wherein:

the transponder has a unique ID code; and the operation messages transmitted by the transponder includes the transponder ID code.

28. The transponder of claim 20 wherein:

the transponder actuators include a handbrake release actuator; and the transponder controller causes the handbrake release actuator to release the handbrake in response to the receipt of handbrake release control commands.

29. The transponder of claim 20 wherein:

the transponder sensors include a slid wheel sensor for detecting slid wheel events; and the transponder controller causes the data link to transmit slid wheel event operation messages in response to the receipt of slid wheel control commands.

30. The transponder of claim 29 wherein the slid wheel sensor includes an acceleration sensor for sensing transponder acceleration.

31. The transponder of claim 30 wherein:

the transponder sensors further include a handbrake state sensor for sensing handbrake states; and the transponder controller identifies slid wheel events as a function of the sensed transponder acceleration and the sensed handbrake state.

32. A remotely operable rail car monitor and control system, comprising:

a plurality of RF transponder systems, each adapted to be mounted to a rail car and including:

sensors for sensing information representative of rail car operating events and rail car system status;

one or more actuators for actuating systems of the rail car;

an RF data link for receiving transponder control commands and transponder wake-up commands, and for transmitting rail car operation messages; and a digital controller coupled to the sensors, actuators and data link and operable in an inactive sleep mode and an active normal mode, including:

memory means for storing information including a unique transponder ID code and information representative of rail car operating events and rail car system status;

mode control means for causing the transponder to operate in an active normal mode in response to the receipt of wake-up commands, and to operate in an inactive sleep mode upon completion of active mode operation;

sensed event control means for causing information representative of rail car operation events to be stored in the memory means while the transponder operates in the sleep mode;

actuation control means for actuating the actuators as a function of received transponder control commands while the transponder operates in the normal mode; and message control means for causing the transmission of rail car operation messages including information on rail car operating events and rail car system status as a function of transponder control commands while the transponder operates in the normal mode; and a transportable RF data terminal for providing remote communications with each of the transponder systems, comprising:

a visual display;

a keyboard for enabling an operator to select transponder control commands and transponder wake-up commands;

a data link for transmitting transponder control commands and transponder wake-up commands, and for receiving rail car operation messages; and a digital controller coupled to the display, keyboard and data link, including:

wake-up control means for causing the data terminal to transmit wake-up commands selected through the keyboard;

rail car control means for causing the data terminal to transmit rail car control commands selected through the keyboard; and message display means for causing the display to display rail car operation information including the rail car ID code, rail car operation events and rail car system status as a function of rail car operation messages received form the transponders.

33. A transponder for communication with a transportable data terminal in a remotely operable rail car monitor and control system, the transponder adapted to be mounted to a rail car and including:

sensors for sensing information representative of rail car operating events and rail car system status;

one or more actuators for actuating systems of the rail car;

an RF data link for receiving transponder control commands and transponder wake-up commands, and for transmitting rail car operation messages; and a digital controller coupled to the sensors, actuators and data link and operable in an inactive sleep mode and an active normal mode, including:

memory means for storing information including a unique transponder ID code and information representative of rail car operating events and rail car system status;

mode control means for causing the transponder to operate in an active normal mode in response to the receipt of wake-up commands, and to operate in an inactive sleep mode upon completion of active mode operation;

sensed event control means for causing information representative of rail car operation events to be stored in the memory means while the transponder operates in the sleep mode;

actuation control means for actuating the actuators as a function of received transponder control commands while the transponder operates in the normal mode; and message control means for causing the transmission of rail car operation messages including information on rail car operating events and rail car system status as a function of transponder control commands while the transponder operates in the normal mode.

* * * * *